US006423226B1

(12) United States Patent
Hopkins et al.

(10) Patent No.: US 6,423,226 B1
(45) **Date of Patent: *Jul. 23, 2002**

(54) FILTER PACKAGE

(75) Inventors: Scott D. Hopkins, Dryden; Daniel W. Spencer, Cortland; Joseph A. Peri, DeRuyter, all of NY (US)

(73) Assignee: Pall Corporation, East Hills, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/007,675

(22) Filed: Dec. 10, 2001

Related U.S. Application Data

(63) Continuation of application No. 09/736,405, filed on Dec. 15, 2000, now Pat. No. 6,338,798, which is a continuation of application No. 09/310,147, filed on May 12, 1999, now Pat. No. 6,174,439, which is a continuation of application No. 08/650,132, filed on May 8, 1996, now Pat. No. 5,928, 516, which is a continuation-in-part of application No. PCT/US96/01348, filed on Jan. 19, 1996, which is a continuation-in-part of application No. 08/376,217, filed on Jan. 20, 1995, now abandoned.

(51) Int. Cl.[7] ..... B01D 63/14

(52) U.S. Cl. ..... 210/321.86; 210/493.2; 210/636; 53/434; 53/167; 53/469

(58) Field of Search ..... 210/321.86, 493.1, 210/636, 416.2; 422/21, 25, 26; 53/465, 167, 79, 469, 534

(56) References Cited

U.S. PATENT DOCUMENTS

| | | | | |
|---|---|---|---|---|
| 3,016,284 | A | | 1/1962 | Trexler |
| 3,088,255 | A | | 5/1963 | Griem |
| 3,229,813 | A | | 1/1966 | Crowe, Jr. et al. |
| 3,468,471 | A | | 9/1969 | Linder |
| 3,754,368 | A | | 8/1973 | Moore et al. |
| 4,176,070 | A | | 11/1979 | Sakurada et al. |
| 4,176,156 | A | | 11/1979 | Asanuma et al. |
| 4,177,620 | A | | 12/1979 | Daly et al. |
| 4,295,563 | A | | 10/1981 | Becker et al. |
| 4,411,866 | A | | 10/1983 | Kanno |
| 4,727,705 | A | | 3/1988 | Zahka |
| 4,810,469 | A | | 3/1989 | Masuhara |
| 4,840,709 | A | | 6/1989 | Nejigaki et al. |
| 5,044,141 | A | | 9/1991 | Franchi |
| 5,164,166 | A | | 11/1992 | Stepanski et al. |
| 5,480,565 | A | | 1/1996 | Levin et al. |
| 5,556,591 | A | | 9/1996 | Jallerat et al. |
| 5,928,516 | A | * | 7/1999 | Hopkins et al. |
| 6,174,439 | B1 | * | 1/2001 | Hopkins et al. |
| 6,338,798 | B2 | * | 1/2002 | Hopkins et al. |

FOREIGN PATENT DOCUMENTS

| | | |
|---|---|---|
| CH | 318667 | 2/1957 |
| CH | 574356 | 4/1976 |
| DE | 3724803 | 2/1989 |
| EP | 0139822 | 5/1985 |
| JP | 59175065 | 11/1984 |
| JP | 01249715 | 10/1989 |
| JP | 2784656 | 9/1990 |

* cited by examiner

*Primary Examiner*—Ana Fortuna
(74) *Attorney, Agent, or Firm*—Leydig, Voit & Mayer, Ltd.

(57) ABSTRACT

A filter package having a long shelf-life and containing substantially no contaminants comprises a filter cartridge, a flexible bag surrounding the filter cartridge having walls comprising a polymeric material impervious to microorganisms and liquid water, a venting mechanism formed in a wall of the flexible bag, and sanitized water sealed inside the flexible bag and immersing substantially 100% of a volume of the filter cartridge. The filter cartridge includes a porous filter medium having a plurality of pores through which a fluid can pass between an upstream side and a downstream side of the filter cartridge and the sanitized water substantially permeates the pores of the filter medium. The venting mechanism includes a vent filter preventing the passage of microorganisms into the flexible bag.

4 Claims, 6 Drawing Sheets

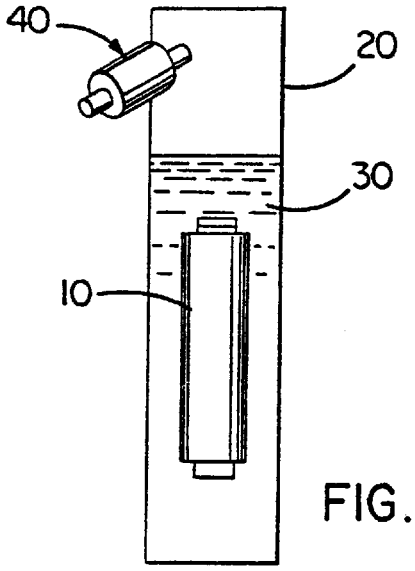
FIG. 1
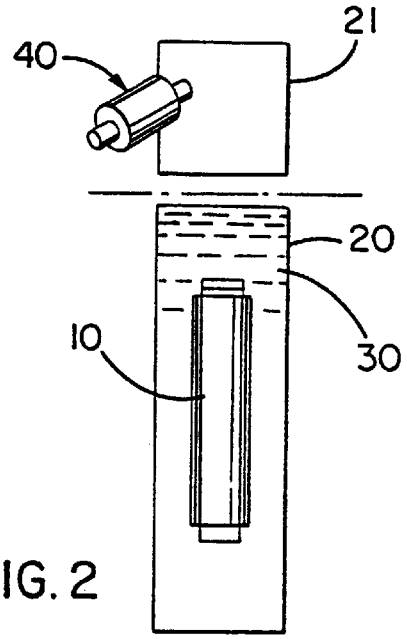
FIG. 2
FIG. 3
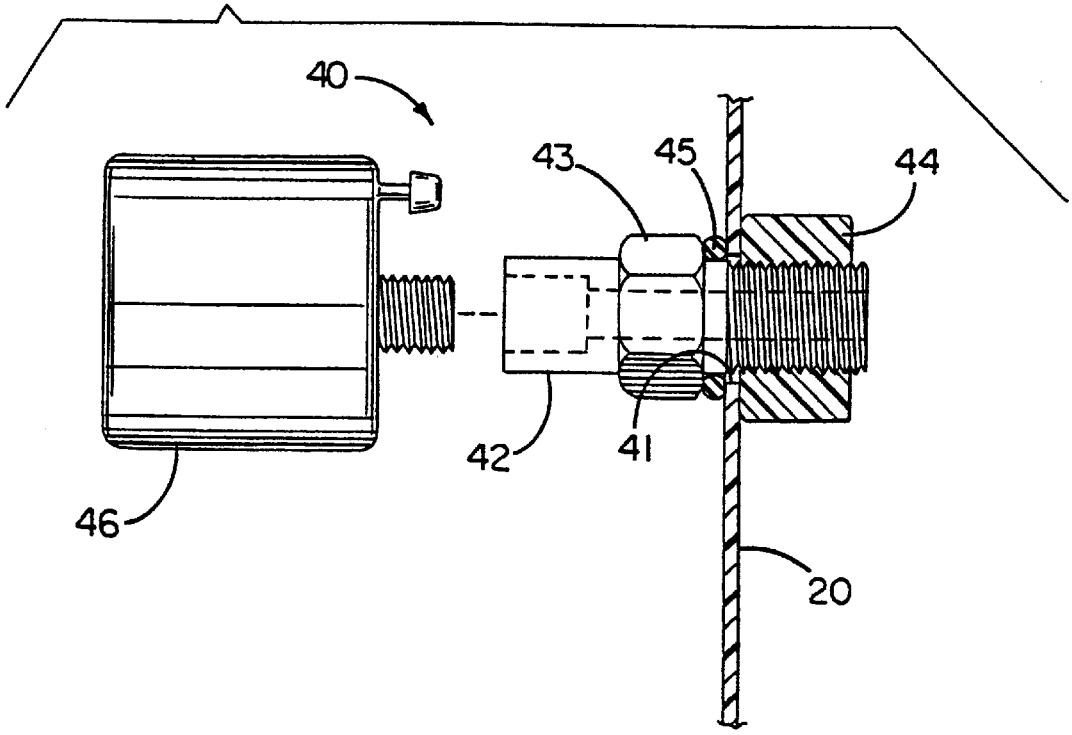

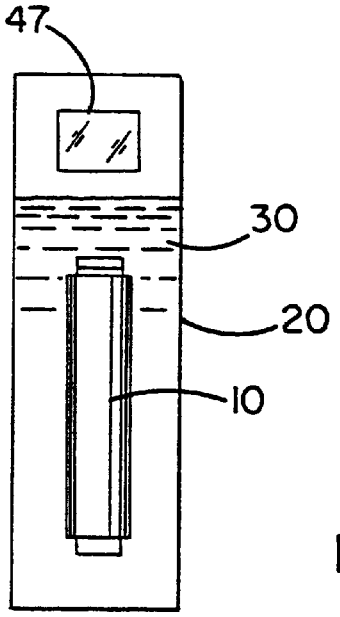
FIG. 4
FIG. 5
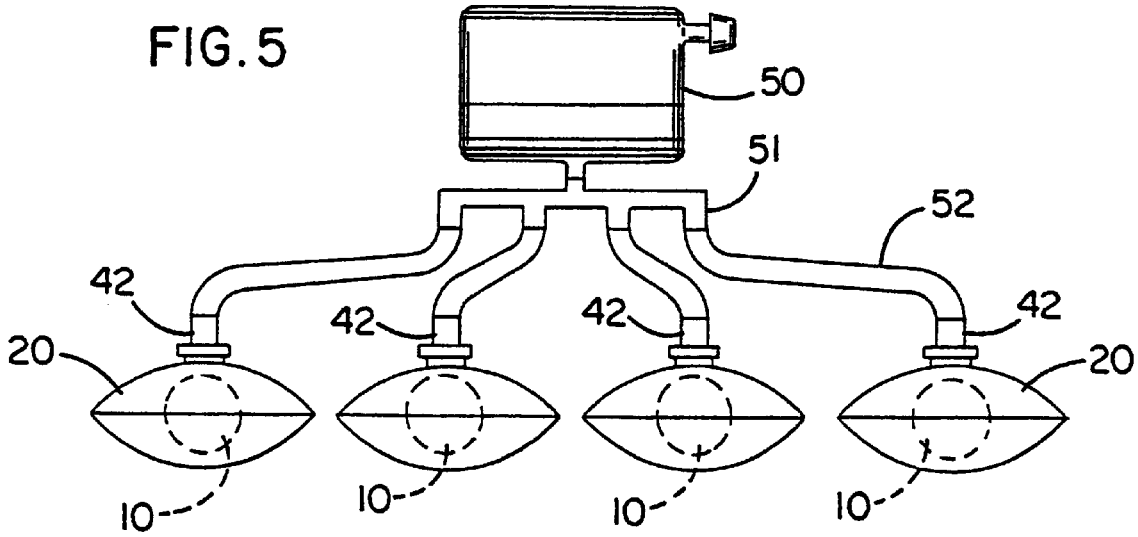

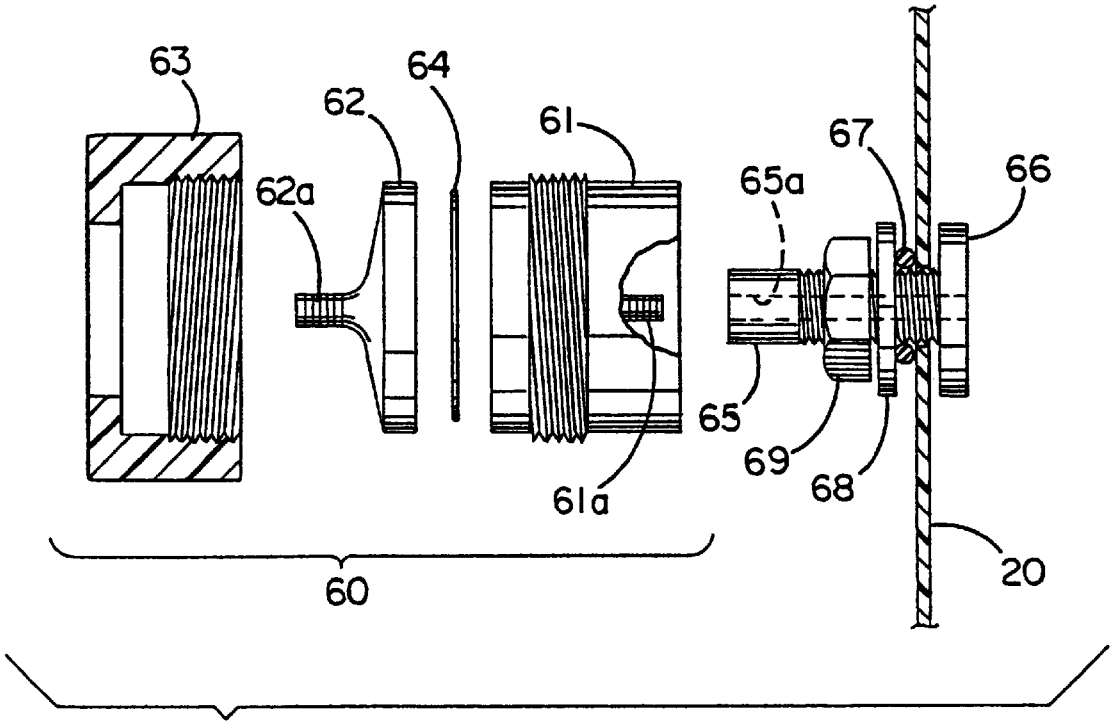
FIG. 6
FIG. 7
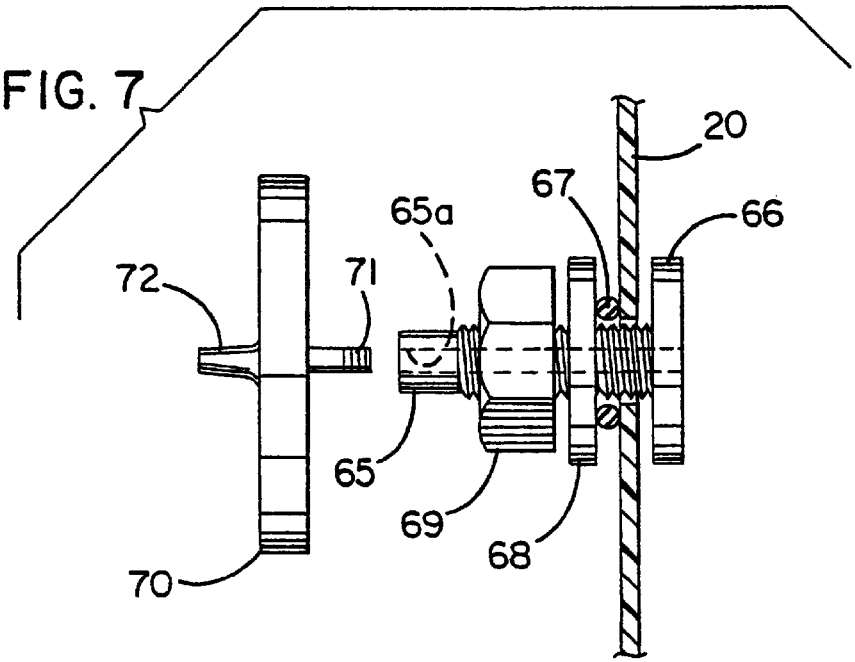

FILTER PACKAGE

REFERENCE TO RELATED APPLICATIONS

This application is a continuation of U.S. application Ser. No. 09/736,405, filed on Dec. 15, 2000, now U.S. Pat. No. 6,338,798, which is a continuation of U.S. patent application Ser. No. 09/310,147, filed on May 12, 1999 now U.S. Pat. No. 6,174,439 which is a continuation of U.S. patent application Ser. No. 08/650,132, filed on May 8, 1996 now U.S. Pat. No. 5,928,516 which is a continuation-in-part of U.S. patent application Ser. No. 08/376,217, filed on Jan. 20, 1995, now abandoned, and of International Application No. PCT/US96/01348, filed on Jan. 19, 1996, all of which are hereby incorporated by reference in their entirety.

BACKGROUND OF THE INVENTION

1. Field of the Invention

This invention relates to a filter package containing a filter immersed in a liquid and to a method of forming such a filter package. More particularly, it relates to a filter package the contents of which are sanitized and preferably sterilized.

2. Description of the Related Art

It is common for filters to be stored and shipped in a wet state, immersed in a suitable liquid within a package. There are several reasons for packaging a filter in this manner. Some filters are not readily wettable by the liquid which they are intended to filter and so are usually prewetted with another liquid having a lower surface tension to prepare the filter for filtration. As a service to the customer, some filter manufacturers perform prewetting at the factory where the filter is manufactured. In order to prevent the prewetted filter from drying out during storage or shipment, the filter is packaged in a sealed bag containing a suitable liquid which keeps the filter wetted until it is ready to be used.

Other types of filters, such as ultrafiltration and reverse osmosis membranes, are not "prewetted" by the manufacturer but are nevertheless shipped to the customer in a wet state in order to maintain their permselective properties. These filters are typically stored and shipped in packages containing a humectant such as glycerin which keeps the filter wet.

Another reason for packaging a filter in a wet state is that it is easier to ensure the cleanliness of such a filter than if it is packaged in a dry state. Thus, even filters which do not require prewetting and which do not need to be kept wet to maintain their filtering properties may be packaged in a wet state for reasons of cleanliness.

In order to give a filter package containing a wet filter a suitable shelf-life, hydrogen peroxide or other bactericide is usually added to the liquid within the package in order to prevent bacterial growth between the time of manufacture and the time that the purchaser opens the package.

Even though the amount of the bactericide is relatively small (typically around 3% in the case of hydrogen peroxide), in some applications, and particularly in the manufacture of semiconductors, the bactericide is an undesirable contaminant. Accordingly, there is a need for a filter package containing a filter in a wet state which has a long shelf-life yet which contains substantially no contaminants.

SUMMARY OF THE INVENTION

In accordance with one aspect of the invention, a filter package having a long shelf-life and containing substantially no contaminants comprises a filter cartridge, a flexible bag surrounding the filter cartridge having walls comprising a polymeric material impervious to microorganisms and liquid water, a venting mechanism formed in a wall of the flexible bag, and sanitized water sealed inside the flexible bag and immersing substantially 100% of a volume of the filter cartridge. The filter cartridge includes a porous filter medium having a plurality of pores through which a fluid can pass between an upstream side and a downstream side of the filter cartridge and the sanitized water substantially permeates the pores of the filter medium. The venting mechanism includes a vent filter preventing the passage of microorganisms into the flexible bag.

The contents of the filter package of the present invention are at least sanitized, i.e., all or substantially all non-spore producing microorganisms are killed, and preferably the contents of the package are fully sterilized. In this description, "sterilizing" is included within the scope of the term "sanitizing". Thus, a sanitized filter package according to the present invention may be one which has been fully sterilized or one which has been sanitized without being fully sterilized.

The sanitizing can be performed in any manner which will not damage or degrade the filter or the container. In preferred embodiments, sanitizing is performed by heating the liquid and the filter within the container. When sanitizing is performed by heating, the container may be vented during sanitizing to permit vapor of the liquid to exit from the container and prevent the build-up of pressures which could damage the container.

A filter package according to the present invention is not restricted to one having any particular type of filter. For example, the filter may be either hydrophilic or hydrophobic, it may be a filter for filtration of gases, liquids, slurries, or mixtures of more than one phase, and the mechanism by which it performs filtration is not important. A few examples of various types of filters which may be employed in the present invention are particulate filters, particularly for use in the semiconductor industry, coalescers, ultrafiltration membranes, and reverse osmosis membranes.

If desired, the filter may be prewetted prior to being immersed in liquid in the container so that it can be completely wetted by the liquid in which it is immersed.

BRIEF DESCRIPTION OF THE DRAWINGS

FIG. 1 is a schematic elevation of a filter package according to the present invention prior to sanitizing.

FIG. 2 is a schematic elevation of the filter package of FIG. 1 after being hermetically sealed.

FIG. 3 is a partly cross-sectional view of the venting mechanism of the embodiment of FIG. 1.

FIG. 4 is a schematic elevation of a filter package in which a venting mechanism is formed by a semipermeable membrane.

FIG. 5 is a schematic plan view of an assembly including a plurality of filter packages connected to a common vent filter.

FIGS. 6 and 7 are side elevations of different types of vent filters which can be employed in the present invention.

DESCRIPTION OF PREFERRED EMBODIMENTS

Figure 8:
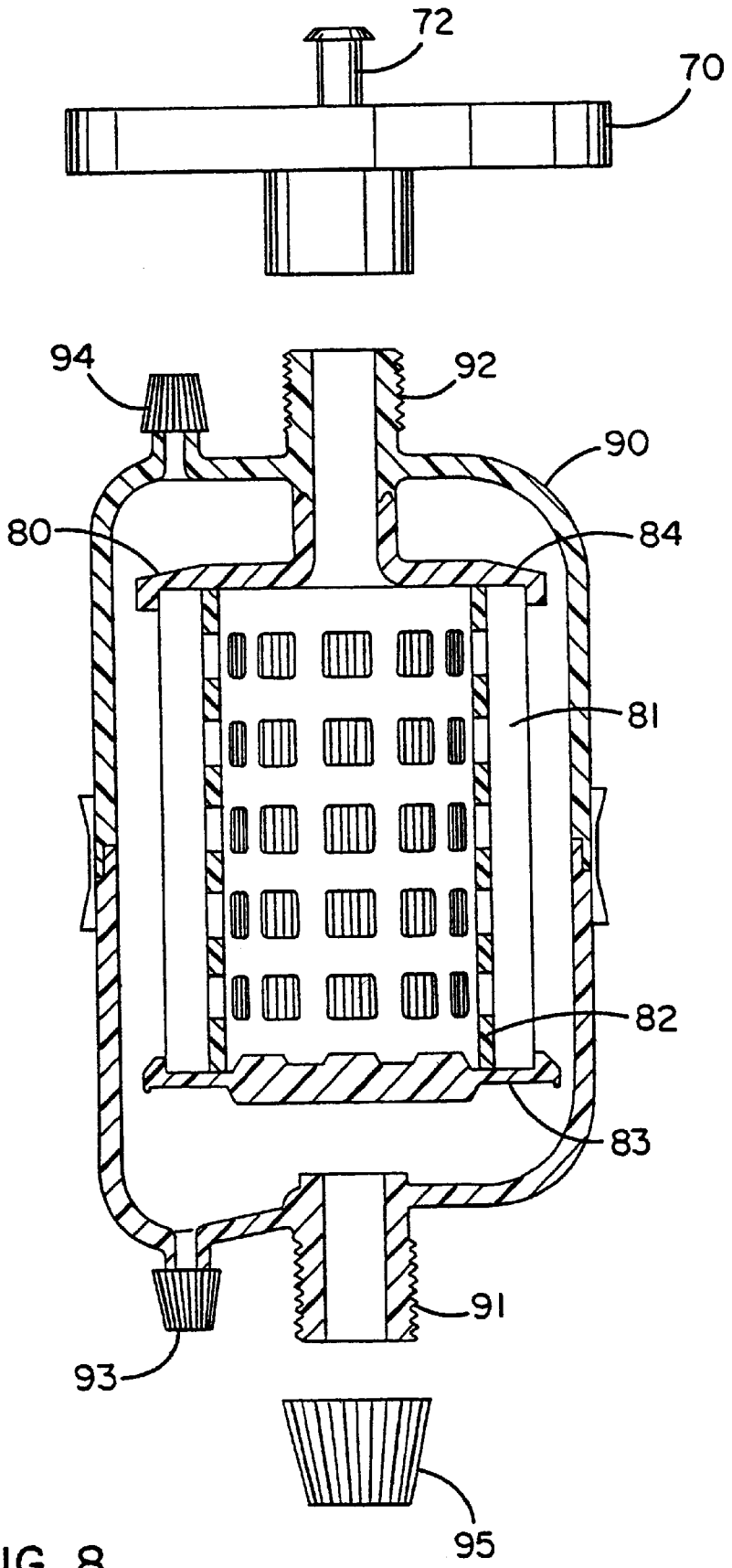
FIG. 8 is a cross-sectional elevation of a filter assembly which can be formed into a filter package according to the present invention.

FIGS. 1 and 2 schematically illustrate a method of preparing a filter package according to the present invention. A filter 10 and a noncontamninating liquid 30 are placed in a container, such as a bag 20, to immerse the filter 10 in the noncontaminating liquid 30. After the bag 20 is closed to prevent liquid or microorganisms from entering it, the filter 10 and the noncontaminating liquid 30 are sanitized and preferably sterilized while in the bag 20. Next, as shown in FIG. 2, the bag 20 is preferably hermetically sealed to obtain a completed filter package.

Prior to being placed into the bag 20, the filter 10 may be prewetted so that it can be readily wetted by the fluid with which it is to be used and thus be ready for use by the customer. Alternatively, depending on the nature of the filter 10, its end use, and the requirements of the purchaser, the filter 10 may be packaged without being prewetted. However, if a high degree of cleanliness of the filter 10 is important and if the filter 10 is not readily wettable in a dry state by the noncontaminating liquid 30, then it is preferable to prewet the filter 10 such that the noncontaminating liquid 30 can readily penetrate the pores of the filter 10.

The filter 10 can be prewetted using any known method appropriate for the type of the filter 10. For example, the standard prewetting procedures recommended by the manufacturer of the filter 10 are suitable. A common method of prewetting is to immerse the entire filter 10 in a vessel containing a prewetting liquid having a low surface tension, such as isopropyl alcohol or methyl alcohol, and to allow the prewetting liquid to permeate the filter medium. The prewetting liquid is preferably filtered prior to use in order to remove any possible particulate contaminants from the prewetting liquid. If the prewetting liquid would be a contaminant in the fluid system in which the filter 10 is to be used, the prewetting liquid is preferably flushed out of the filter 10 using a suitable noncontaminating liquid, such as deionized water. Flushing of the filter 10 with a noncontaminating liquid can be performed using conventional procedures. After prewetting and possibly flushing, the filter 10 is disposed in the bag 20 before the filter 10 has had a chance to dry.

The bag 20 or other container in which the filter 10 is packaged is not restricted to any particular type and can be either rigid or flexible. It can be any size and shape which enables it to completely enclose the filter 10 and the noncontaminating liquid 30 in which the filter 10 is immersed. If the filter 10 is durable enough to withstand forces likely to be encountered during storage and shipment, a flexible, thin-walled bag 20 is particularly suitable as the container since the bag 20 can be inexpensively manufactured and is easy to seal and handle.

The bag 20 can be made of any material which is impermeable to the noncontaminating liquid 30 and to microbes and is capable of withstanding the conditions occurring during sanitizing without decomposing or releasing contaminants into the noncontaminating liquid 30. The bag 20 is also preferably impermeable to vapor of the noncontaminating liquid 30 and other gases, and to any liquids which the bag 20 is likely to contact during storage or shipment. High-temperature thermoplastic fluoropolymers are particularly suitable for use as the bag material because they are strong, lightweight, readily sealed, and can withstand sterilizing temperatures. Examples of suitable materials for the bag 20 when the noncontaminating liquid 30 is water are PFA perfluoroalkoxy), FEP (fluorinated ethylene-propylene), PVDF (polyvinylidene fluoride), and ECTFE (ethylene chlorotrifluoroethylene). Non-polymeric materials such as metal foils may also be used, as may a combination of one or more materials, such as a laminate of aluminum foil and Mylar film. If sanitizing is performed using heating, nuclear irradiation, ozone, or ultrasonics, for example, the bag 20 need not be permeable to light However, it may be easier to seal the bag 20 if it is made of a transparent or translucent material so that the filter 10 and the level of the noncontaminating liquid 30 are visible to the person performing the sealing.

The type of noncontaminating liquid 30 placed into the bag 20 and its purity can be selected in accordance with the characteristics of the filter 10 and the fluid system in which the filter 10 is to be employed. A preferred noncontaminating liquid is ultrapure deionized water having an initial resistivity of at least 18 MΩ-cm and more preferably at least 18.1 MΩ-cm. The initial resistivity of the deionized water refers to its resistivity prior to use and at the time it is placed into the bag 20. Due to the presence of substances in the air, the filter 10, or the inside of the bag 20 which may come into contact with the deionized water during assembly of the filter package, the resistivity of the deionized water may decrease somewhat from its initial resistivity after it is placed into the bag 20. However, the level of contaminants in the deionized water within the bag 20 during sanitizing is preferably at most in the parts per billion range. Thus, during sanitizing, the bag 20 preferably contains essentially only the filter 10, the noncontaminating liquid 30, and possibly air or other gas above the surface of the noncontaminating liquid 30. No bactericides are present in the bag 20. When the noncontaminating liquid 30 is introduced into the bag 20, the filter 10 and the bag 20 may be disposed in an atmosphere of a gas having a low solubility in the noncontaminating liquid 30 to prevent gases in the air from being dissolved in the liquid 30. For example, when the noncontaminating liquid 30 is deionized water, the liquid 30 may be introduced into the bag 20 inside a nitrogen atmosphere to prevent $CO_2$ in the air from dissolving in the liquid 30. However, in general, gases present in ordinary clean atmospheric air are not contaminants with respect to the filter 10, so it is typically not necessary to prevent them from contacting the noncontaminating liquid 30.

The filter 10 can be of any type and shape capable of being sanitized. For example, it may have a pleated or nonpleated filter medium and may include conventional equipment such as a perforated core, an outer cage, one or more end caps, and sealing members (O-rings, etc.) for connecting the filter 10 to a fluid system. The filter 10 may be in the form of a cartridge intended for installation in a housing. Alternatively, it may already be installed in a housing, as long as the housing does not interfere with prewetting and sanitizing. For example, the filter 10 can be installed in a housing having an opening through which a prewetting liquid and then the noncontaminating liquid 30 can be introduced to thoroughly contact the filter 10.

If the filter 10 is to be used within a short length of time after being packaged, such as on the same day, it may be sufficient to subject the contents of the bag 20 to a high degree of sanitization rather than to sterilization. However, in order to give the filter package as long a shelf life as possible, it is preferable to subject the entire contents of the bag 20, including the filter 10 and the noncontaminating liquid 30, to sterilization.

Any known method of sanitizing which will not introduce contamination into the bag 20 or damage the filter 10 or the bag 20 can be used, such as sanitizing using nuclear irradiation, ultraviolet light, ozone, heat, or ultrasonics. Sterilization by heating of the noncontaminating liquid 30 to a sterilizing temperature is preferred because it is simple, reliable, and inexpensive. Heating can be performed in a variety of ways, such as by disposing the bag 20 in an autoclave, in a microwave oven, in a pressure cooker, or in a vessel of boiling water or other liquid at a sterilizing temperature. During sanitizing, the filter 10 is preferably immersed in the noncontaminating liquid 30 in the bag 20 both before and after sanitizing to prevent pores of the filter 10 from drying out during the sanitizing process. More preferably, it is mostly immersed (at least 50% of its volume), and most preferably it is entirely immersed in the noncontarninating liquid 30. If the filter 10 is negatively buoyant in the noncontaminating liquid 30, the filter 10 may be completely immersed simply by filling the bag 20 with a sufficient amount of the noncontaminating liquid 30. If the filter 10 floats in the noncontaminating liquid 30, it may be desirable to hold the filter 10 beneath the surface of the noncontaminating liquid 30 so as to completely immerse the filter 10, such as by pinching the bag 20 from the outside using a clamp disposed below the surface of the noncontaminating liquid 30 and above the top of the filter 10 to prevent the filter 10 from floating to the surface. During sanitizing, care is preferably taken that the bag 20 does not come into contact with any members which are at a temperature which could produce thermal deformation of the bag 20 or the filter 10. Care should also be taken not to boil the inside of the bag 20 dry. The sanitizing conditions, such as the heating temperature and the length of time for which heating is carried out, can be standard conditions. An example of suitable, conventional sterilizing conditions in an autoclave are 1 hour at a gauge pressure of 15 psi and a temperature of approximately 120° C. To reduce the risk of contamination, it may be desirable to perform the sanitizing in a clean room.

If the filter 10 is of a type having a blind end cap and an open end cap, the filter 10 is preferably placed in the bag 20 with the open end cap higher than the blind end cap so that air can escape from the center of the filter 10 through the open end cap and be displaced by the noncontaminating liquid 30.

In some cases, the heating of the filter 10 during sanitizing may produce leaching of extractables from the filter 10 into the noncontaminating liquid 30. In order to reduce the amount of leaching, the filter 10 may be pretreated prior to insertion into the bag 20 by immersion in hot deionized water (preferably at approximately 160 to approximately 200° F., such as at 165° F.=approximately 74° C.) to leach out extractables prior to sanitizing.

The upper end of the bag 20 is preferably closed during and after sanitizing in a manner such that contaminants cannot enter the bag 20. Closure of the upper end can be performed in any suitable manner which does not introduce contamination, such as by heat sealing. However, even though the bag 20 is preferably closed, it is preferably not hermetically sealed as a whole during sanitizing but rather is closed in a manner such that vapor of the noncontaminating liquid 30 and air can exit from the bag 20 while dust, microorganisms, and other contaminants are prevented from entering. When sanitizing takes place by heating, the pressure in the bag 20 will increase due to an increase in the vapor pressure of the noncontaminating liquid 30, boiling of the noncontaminating liquid 30, and/or gases in the noncontaminating liquid 30 coming out of solution. If the bag 20 is hermetically sealed during sanitizing, it is desirable to take steps to ensure that the pressure which builds up within the bag 20 does not rupture or otherwise damage the bag 20, such as making the walls of the bag 20 sufficiently thick to resist the internal pressure without damage, or pressurizing the inside of the autoclave with air to reduce the amount of swelling of the bag 20 during heating. However, increasing the wall thickness of the bag 20 raises costs and makes the bag 20 more difficult to handle, while pressurizing the autoclave reduces the efficiency of heating in the autoclave. Therefore, a preferred method of preventing damage to the bag 20 by an increase in internal pressure is to provide the bag 20 with a venting mechanism 40 which is able to release vapor of the noncontaminating liquid 30 and other gases generated during heating which could cause deformation or rupture of the bag 20.

A venting mechanism 40 can be installed on the bag 20 in any location in which it can allow vapor of the noncontaminating liquid 30 or other gases to escape from the bag 20. During sanitizing by heating, the bag 20 is preferably positioned so that the venting mechanism 40 is in an upper portion of the bag 20 where air and other gases can accumulate. The venting mechanism 40 can be structured in any manner which allows the discharge of vapor of the noncontaminating liquid 30 and other gases from the bag 20 during sanitizing. FIG. 3 illustrates an example of a venting mechanism 40 in detail. It includes a vent hole 41 formed in a wall of the bag 20 and a hollow vent tube 42 passing through the vent hole 41 and communicating between the inside and outside of the bag 20. The vent tube 42 may be omitted, but it provides a convenient way of connecting the vent hole 41 to external hardware. The vent tube 42 is secured to the bag 20 by means of a nut 44 disposed inside the bag 20 which screws onto external threads formed on the inner end of the vent tube 42. A nut 43 is integrally formed on the outer end of the vent tube 42 on the outside of the bag 20. In order to form a hermetic seal around the vent hole 41, a seal member such as an elastomeric O-ring 45 is disposed around the vent tube 42 near the periphery of the vent hole 41 between the wall of the bag 20 and one of the nuts 43 and 44. The O-ring 45 is pressed into sealing contact with the bag 20 by tightening of the nuts 43 and 44. The O-ring 45 may be disposed on either the inside or the outside of the bag 20, but as the O-ring 45 may possibly introduce contaminants, it is preferably on the outside of the bag 20.

The vent tube 42 and the nuts 43 and 44 can be made of any corrosion resistant material which can resist the temperatures occurring during sanitizing. Examples of suitable materials are polymers such as FEP, PFA, PVDF, and ECTFE and metals such as stainless steel.

A wide variety of other methods can be employed to sealably mount the vent tube 42 on the bag 20, such as the use of bulkhead fittings. Furthermore, the vent tube 42 may be permanently connected to the bag 20 by a method such as welding. However, it is often advantageous if the vent tube 42 is detachable from the bag 20 so that the vent tube 42 can be reused with different bags.

Another possible type of venting mechanism is a sheet of a semipermeable membrane which is permeable to water vapor but impermeable to liquid water and microorganisms, such as a PTFE (polytetrafluoroethylene) membrane forming a section of the bag 20. FIG. 4 illustrates an embodiment in which a venting mechanism comprising a semipermeable membrane 47 of PTFE forms a section of the wall of the bag 20, the remainder of the bag 20 being made of PFA. The membrane 47 is located in an upper portion of the bag 20, in substantially the same location as the venting mechanism 40 of FIG. 1. Sanitizing is performed using this bag 20 in the same manner as with the bag 20 illustrated in FIG. 1.

Alternatively, the entire bag 20 can be made of a semipermeable membrane, such as a PTFE membrane, which is permeable to water vapor but not to liquid water or microbes, in which case a separate venting mechanism becomes unnecessary. However, a bag 20 made of a material which is permeable to water vapor is less preferred, since water vapor can pass through the bag 20 during storage and condense on the outside of the bag 20, making the bag 20 awkward to handle. In addition, over time, all of the noncontaminating liquid may pervaporate from the bag 20, leaving the filter 10 dried out.

Because of the provision of the venting mechanism 40, very little internal pressure acts on the walls of the bag 20 during sanitizing, so the walls of the bag 20 can be quite thin. For example, a bag made of PFA with a wall thickness of 0.002–0.030 inches, such as 0.005 inches has been found to work quite well for sterilization in an autoclave at 15 psi gauge. Decreasing the wall thickness of the bag 20 is advantageous because it decreases material costs and makes the bag 20 easier to seal.

In order to prevent microorganisms and other contaminants from entering the bag 20 through the vent hole 41, either during or after sanitizing, a vent filter 46 which is able to prevent the passage of bacteria or other microorganisms therethrough is preferably hermetically connected to the vent tube 42 so that all air entering the vent tube 42 from outside the bag 20 must pass through the vent filter 46. The term vent filter here refers to any type of filter which allows the passage of vapor of the noncontaminating liquid, and the vent filter need not be a filter intended exclusively for use in venting. Preferably, the vent filter 46 allows the passage of air. An example of a suitable vent filter 46 is a sterilizing grade filter for air filtration. A sterilizing grade filter or filter medium is typically defined as one having a removal rating of 0.2 $\mu$m. Depending on the environment in which the bag 20 is disposed following sanitizing, a vent filter may be unnecessary, or one having a different removal rating, i.e., a non-sterilizing grade filter may be employed. When the noncontaminating liquid 30 in the bag 20 is water, the vent filter 46 is preferably hydrophobic, i.e., having a critical wetting surface tension of less than approximately 50 dynes/cm, so that it does not become wetted during sanitizing, since wetting could prevent the flow of gases through the vent filter 46. In addition, if the noncontaminating liquid 30 is water, a hydrophobic vent filter 46 prevents the noncontaminating liquid 30 from leaking out of the bag 20, even when the bag 20 is turned upside down, making it easier to store the bag 20. However, if the vent filter 46 can be prevented from wetting during sanitizing, a hydrophilic vent filter can also be employed. The vent filter 46 may have any shape and may be either pleated or nonpleated. An example of a suitable vent filter is a DFA4001FRP filter assembly available from Pall Corporation. This filter has a PTFE dual-layer filter medium, an internal core, end caps made of polypropylene, and a critical wetting surface tension of less than 30 dynes/cm. Such a filter, when not wetted, is impermeable to liquid water but is permeable to liquids having a surface tension smaller than 30 dynes/cm. The vent filter 46 can be installed in any manner providing a seal which prevents microorganisms from bypassing the vent filter 46, and it may be either permanently or detachably connected to the bag 20. However, a detachable connection is preferred to permit the vent filter 46 to be reused. For example, as shown in FIG. 3, the vent filter 46 and the vent tube 42 can be connected by a threaded coupling.

The noncontaminating liquid 30 can be introduced into the bag 20 in any desired manner. For example, it can be introduced through the open end of the bag 20 before it is closed, or it can be introduced through the vent tube 42 of the venting mechanism after the bag 20 has been closed and before the vent filter 46 has been installed on the vent tube 42.

After the contents of the bag 20 have been sanitized, the bag 20 is preferably hermetically sealed. Since a hydrophobic vent filter can prevent leakage from the bag 20 as well as prevent water and microbes from entering the bag 20, it is not mandatory to hermetically seal the bag 20, but doing so allows the venting mechanism 40 to be detached from the bag 20 and makes the bag 20 easier to handle. Before sealing is performed, it may be desirable to allow the bag 20 to cool to a comfortable handling temperature. During cooling, the vent filter 46 prevents microbes and other contaminants from entering the bag 20 and maintains the contents of the bag 20 sterile. Any known method of hermetically sealing the bag 20 can be employed. When the bag 20 is made of a polymeric material, heat sealing is particularly suitable. Other methods such as ultrasonic sealing and vibration welding can also be employed. The bag 20 can be sealed at any desired location, including below the surface of the noncontaminating liquid 30 so as to exclude all air from the inside of the bag 20. While preferably the bag 20 contains no air above the surface of the noncontaminating liquid 30 after being sealed, since any air in the bag 20 has been sterilized and is at 100% relative humidity, it is not detrimental to have some air remaining in the bag 20 after sealing because the air will neither contaminate nor dry out the filter 10. After the bag 20 is sealed, the upper portion of the bag 20 including the venting mechanism 40 can be detached from the lower portion of the bag 20 and salvaged for reuse. If the venting mechanism 40 does not need to be reused, it can be left attached to the bag 20, but in this case it is preferably disabled from venting, since water vapor passing through the venting mechanism 40 could condense on the outer surface of the bag 20 during storage and form a puddle of water surrounding the bag 20. In the embodiment of FIG. 1, the venting mechanism 40 could be disabled by forming a seal around the vent hole 41, such as by heat sealing, to isolate the vent hole 41 from the inside of the bag 20.

It may be desirable to simultaneously sanitize a plurality of filters 10 housed in individual bags 20 or other containers. Instead of equipping each of a plurality of bags 20 with its own vent filter, the vent tubes 42 of the plurality of bags 20 can be connected to a single vent filter 50 by a manifold 51 and hoses 52, as schematically illustrated in FIG. 5. The vent filter 50 is selected to be large enough to provide filtration of air for all of the bags 20. The entire assembly of the plurality of bags 20 and the vent filter 50 can be placed in an autoclave at one time to sanitize the filters 10 as a batch.

Alternatively, a plurality of filters 10 can be disposed in a single bag 20 like that shown in FIG. 1 so as to simultaneously sanitize the plurality of filters 10.

FIGS. 6 and 7 illustrate other examples of vent filters through which the bag 20 can be vented during sanitizing. The vent filter 60 of FIG. 6 comprises a commercially available filter holder and a sheet of a filter medium 64 disposed inside the filter holder. The filter holder has a generally cylindrical housing including a base 61 and a cover 62 between which the filter medium 64 can be placed. The base 61 and the cover 62 are sealed to each other by a nut 63 which surrounds the cover 62 and screws onto external threads formed on the base 61. One or both of the base 61 and the cover 62 may include a perforated support plate for supporting the filter medium 64. The filter holder is usually purchased without the filter medium 64, which is installed by the user. First and second fluid ports 61*a* and 62*a* communicating with opposite sides of the filter medium 64 when the filter holder is assembled extend from the base 61 and the cover 62, respectively. The base 61 is partly cut away in the figure to show the first fluid port 61*a*. Filter holders of this and other types which enable a filter medium to be installed and replaced by the user are available from a variety of sources, such as Cole-Parmer Instrument Company of Niles, Ill. The filter medium 64 which is supported by the filter holder can be one having any desired properties. An example of a suitable filter medium 64 for use in the present invention is a hydrophobic, sterilizing grade membrane filter medium of PTFE.

The bag 20 in this embodiment is equipped with a hollow vent tube 65 having a central bore 65a extending through its length. A hollow circular flange 66 having an outer diameter larger than that of the vent tube 65 is formed on the inner end of the vent tube 65. The vent tube 65 extends through a hole in the wall of the bag 20, with the flange 66 disposed on the inside of the bag 20. A sealing member such as an O-ring 67, a washer 68, and a nut 69 are mounted on the vent tube 65 on the outside of the bag 20. The nut 69 is threadingly engaged with external threads formed on the vent tube 65. When the nut 69 is tightened, the washer 68 is urged towards the flange 66, and as a result, the bag 20 is compressed between the O-ring 67 and the flange 66, causing the O-ring 67 to be pressed into sealing contact with the bag 20 to form a seal around the hole in the bag 20. The O-ring 67 may be separate from the washer 68, or it may be attached to the washer 68 by an adhesive, for example. The vent tube 65 may be fluidly connected to either of the fluids ports 61*a* and 62*a* of the filter holder in any suitable manner. For example, the inner bore 65*a* of the vent tube 65*a* may be formed with internal threads which mate with external threads formed on the fluid ports. Alternatively, the vent tube 65 and one of the fluid ports of the vent filter 60 can be connected by a hollow connecting member such as a pipe or flexible tubing.

A vent filter comprising a filter holder which can be assembled and disassembled by the user has a number of useful attributes. Filter holders are available in a variety of sizes, so the user can select a filter holder capable of supporting a filter medium having a surface area appropriate for the application. Since the filter medium can be readily installed in the filter holder by the user, the filter medium can be discarded and replaced when necessary while the filter holder can be reused, making the filter holder economical to employ. In addition, the user has great freedom of choosing a filter medium for use with the filter holder.

The vent filter 70 shown in FIG. 7 comprises a commercially available, disposable filter unit referred to as a syringe filter because it is adapted for mounting on a medical syringe. It includes an unillustrated filter medium sealed inside a plastic housing having first and second fluid ports 71 and 72 communicating with opposite sides of the filter medium. Syringe filters are available with a variety of different filter media. An example of a suitable filter medium for a syringe filter for use in venting a filter package according to the present invention is a hydrophobic, sterilizing grade membrane filter medium. A syringe filter will usually include, within its housing, a perforated support plate on one or both sides of the filter medium. The vent filter 70 can be connected to the bag 20 in any suitable manner, such as by a vent tube 65 like that shown in FIG. 6. Syringe filters are available with a variety of fittings, and the structure of the vent tube 65 and the type of vent filter 70 may be selected so that the two can be connected directly to each other. In FIG. 7, the first fluid port 71 of the vent filter 70 is equipped with external threads which can be screwed into internal threads formed in the outer end of the vent tube 65. Alternatively, the vent filter 70 may be indirectly connected to the vent tube 65 by a flexible hose or a connecting pipe, for example.

At the completion of sanitizing, the vent filters 60 and 70 may be left attached to the bag 20, or they may be detached after the bag 20 has been sealed, in the manner shown in FIG. 2.

If the venting mechanism comprises a semipermeable membrane, as in the embodiment of FIG. 4, and if the membrane 47 is impermeable to microbes, a vent filter is unnecessary.

When sanitizing is performed by heating the filter in a chamber such as an autoclave or an oven, the venting mechanism may vent to either the inside or the outside of the chamber. It is generally simpler if venting is performed to the inside of the chamber, i.e., if the venting mechanism is disposed inside the chamber with the filter. In this case, the venting mechanism is preferably made of materials which can withstand the conditions within the chamber during sanitizing.

As stated above, the container of a filter package according to the present invention may be a rigid container. Sanitizing of a filter in a rigid container, such as a housing for the filter, can be performed in much the same way as sanitizing of a filter in a flexible container, such as a flexible bag. A rigid container refers to one which maintains a substantially constant shape and dimensions without being supported, in contrast to a flexible container such as a flexible bag which is readily deformed and may collapse under its own weight if not internally or externally supported. A rigid container of a filter package according to the present invention may be made of any desired material, such as a metal or a polymeric material. A filter to be sanitized in a rigid container may be prewetted prior to sanitizing, and it may be pretreated in hot deionized water to leach out extractables. Prewetting and pretreatment may be performed either before or after the filter is installed in the container. However, when the container is a filter housing, it is usually easier to perform prewetting and pretreatment after the filter has been installed in the housing to form a filter assembly. Prewetting and pretreatment can be performed by immersing the filter assembly in a suitable liquid or by passing the liquid through the filter housing. After prewetting and pretreatment of the filter, if performed, the filter housing or other rigid container housing the filter is filled with a noncontaminating liquid such as ultrapure deionized water to immerse the filter. Then, the rigid container and the filter are sanitized by a suitable method, including any of the methods described above for use in sanitizing a filter within a flexible bag, such as sanitizing by heating in an autoclave.

When a filter in a rigid container, such as a filter housing, is sanitized by heating, the container may be either sealed or vented. Thus, if the walls of the container are strong enough to resist the internal pressure which develops in the container during heating of the noncontaniinating liquid, the container may be completely sealed during heating by closing all the fluid ports or other openings in the container. If the container has relatively thin walls which could be damaged by the internal pressure during heating, the container may be vented by a suitable venting mechanism. Venting may be carried out through any suitable portion of the container. When the container is a filter housing, it will typically be equipped with a plurality of fluid ports, such as a fluid inlet, a fluid outlet, or an air vent, and the housing may be vented through any one or more of these fluid ports or through a different opening intended specifically for use in venting during heating. The fluid ports or other openings which are not used for venting may be closed off during heating by conventional closures (pipe plugs, pipe caps, tube covers, etc.) appropriate to the structure of the individual fluid ports. A vent filter, such as one of the vent filters used in the embodiments of FIGS. 1–7, may be connected to the fluid port used for venting in order to prevent contaminants from entering the container through the fluid port during heating or when the container is being cooled at the completion of heating. As in the previous embodiments, the vent filter preferably has a sterilizing grade filter medium, and the filter medium may be hydrophobic, if desired, to prevent the noncontaminating liquid from leaking from the container through the fluid port to which the vent filter is connected.

The noncontaminating liquid preferably fills the container as much as possible to exclude all free air from the container during heating. To help free air escape to the outside of the container during the introduction of the noncontaminating liquid, it may be helpful to agitate the container or to introduce the noncontaminating liquid from more than one end of the container. Alternatively, suction may be applied to a fluid port at one end of the container, and the noncontaminating liquid may be introduced through a fluid port at the other end of the container. The filter is preferably mostly immersed (at least 50% of its volume), and most preferably it is entirely immersed in the noncontaminating liquid at the start of sanitizing.

When sanitizing a filter within a rigid container which is vented, such as a vented filter housing, the level of the noncontaminating liquid within the container will usually drop due to vaporization of the noncontaminating liquid. When the container is cooled subsequent to heating, air may enter the container through the vent filter and form a pocket of air in the upper portion of the container above the surface of the noncontaminating liquid. However, as in the case when the container is a flexible bag, it is not detrimental to have some air remaining in the housing after cooling because the air will be free of microorganisms after passing through the vent filter and be at 100% relative humidity, so it will neither contaminate nor dry out the filter. Preferably, there is a sufficient amount of the noncontaminating liquid remaining in the container at the completion of cooling that the filter will be at least 50% immersed, more preferably at least 90% immersed, and still more preferably substantially 100% immersed in any attitude of the container.

A vent filter may be left connected to the container at the completion of sanitizing and shipped to the customer along with the filter package, or the vent filter may be detached and replaced by a closure to hermetically seal the container and allow the vent filter to be reused. If the vent filter is detached, the detachment is preferably performed in a manner which prevents contaminants from entering the container. If the vent filter has a hydrophobic filter medium and is left attached to the container, it is possible but not necessary to close the downstream fluid port of the vent filter, because the hydrophobic filter medium can prevent the noncontaminating liquid from leaking from the container.

FIG. 8 illustrates an embodiment of a filter package according to the present invention in which a rigid container for housing a filter 80 during sanitizing is a filter housing. The illustrated filter package comprises a disposable filter assembly available from Pall Corporation under the trademark DFA. The assembly includes a housing 90 having first and second fluid ports 91 and 92 and manually operated vents 93 and 94 which can be used to vent gas or liquid from the housing 90. The filter 80 which is disposed inside the housing 90 includes a pleated filter element 81 surrounding a hollow perforated core 82, a blind end cap 83 sealed to one end of the filter element 81, and an open end cap 84 sealed to the other end of the filter element 81 and to the second fluid port 92. It may also include an unillustrated perforated cage surrounding the filter element 81. The illustrated filter 80 is intended primarily for radially inward flow, so the first fluid port 91 usually serves as an inlet and the second fluid port 92 usually serves as an outlet, although the functions of the two fluid ports may be reversed. The filter 80 and the housing 90 can be made of any materials which can withstand the conditions (such as temperatures) to which they may be subjected during sanitizing. For example, the filter element 81 of the illustrated filter 80 has a PTFE filter medium, and the core 82, the end caps 83 and 84, and the housing 90 are made of polypropylene. Such a filter assembly can be sanitized by heating in an autoclave.

During sanitizing by heating in an autoclave and subsequent cooling, the housing 90 is preferably connected to a hydrophobic, sterilizing grade vent filter to enable vapor generated by heating to escape to the outside of the housing 90 while preventing microorganisms or other contaminants from entering the housing 90. The vent filter can be connected to any one or more of the fluid ports of the housing 90. In the case of the illustrated filter assembly, the housing 90 is preferably vented through at least the fluid port connected with the open end cap 84, and the open end cap 84 is preferably disposed higher than the blind end cap 83 during sanitizing so that vapor of the noncontaminating liquid 30 and other gases generated inside the core 82 of the filter 80 can flow upwards and out of the filter 80 through the open end cap 84 and not be trapped within the core 82. Fluid ports which are not vented may be sealed off during sanitizing by a stopper, a cap, or other suitable closure.

Figure 9:
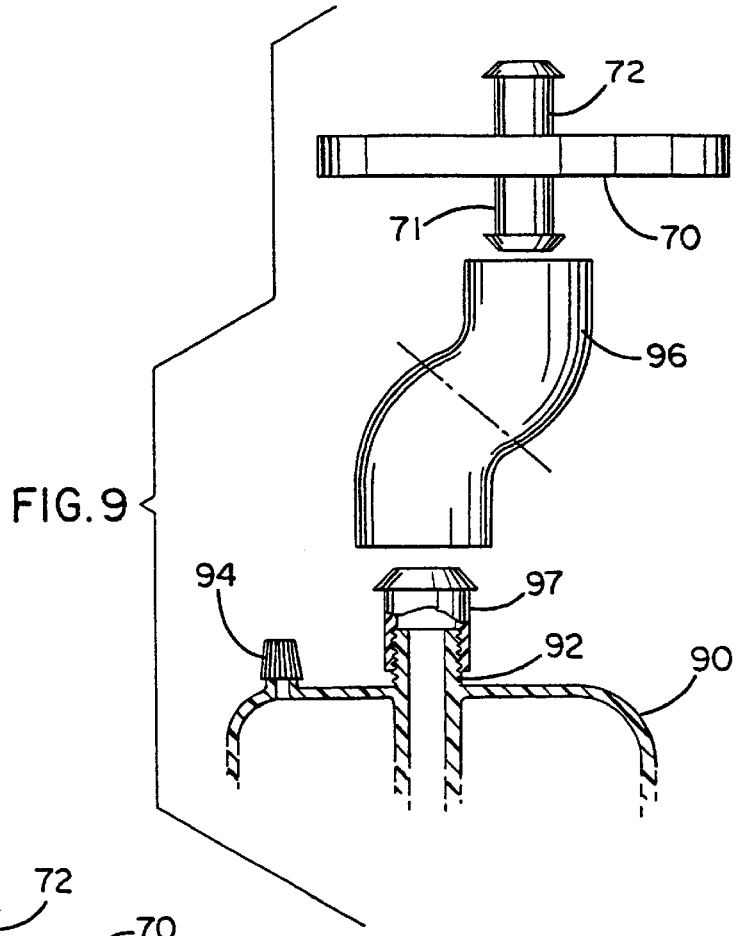
FIG. 9 is a partially cross-sectional view illustrating the use of flexible tubing to connect a filter assembly to a vent filter.

The vent filter 70 in this embodiment is a commercially available syringe filter like that illustrated in FIG. 7, but it may be any other type of vent filter, such as the types shown in FIG. 3 or FIG. 7. The illustrated vent filter 70 has two fluid ports 71 and 72, one of which 71 is formed with internal threads which can be screwed directly onto external threads formed on the second fluid port 92 of the housing 90. Instead of being connected directly to a fluid port of the housing 90, the vent filter 70 may be connected to a fluid port by a connecting member such as a threaded adapter or flexible polymeric tubing 96, as shown in FIG. 9. When tubing 96 is employed, the vent filter 70 may be equipped with a hose barb connector designed for connection to tubing, and the fluid port 92 of the housing 90 to which the vent filter 70 is to be connected may be either formed with a hose barb connector or fitted with a commercially available adapter 97 which has a hose barb connector at its outer end and which screws over the fluid port 92. Tubing 96 is a convenient means of connecting a filter housing of a filter assembly with a vent filter because at the completion of sanitizing and cooling of the filter assembly, the filter housing 90 can be hermetically sealed by heating the tubing 96 at a location (such as that shown by the dashed lines in FIG. 9) between the fluid port 92 and the vent filter 70 to melt the tubing 96 closed. The tubing 96 can be severed on the outer side of the melted portion to leave a short length of the tubing 96 attached to the housing 90, and the vent filter 70 can then be detached from the outer end of the tubing 96 and reused. Tubing 96 can be used not just with a syringe filter but with any of the other types of vent filters described above. During sanitizing, the tubing 96 may be contain air, or it may be partially or completely filled with the noncontaminating liquid, so that as the noncontaminating liquid within the housing 90 is boiled off, liquid within the tubing 96 can flow into the housing 90 to replace the liquid which boiled off.

Figure 10:
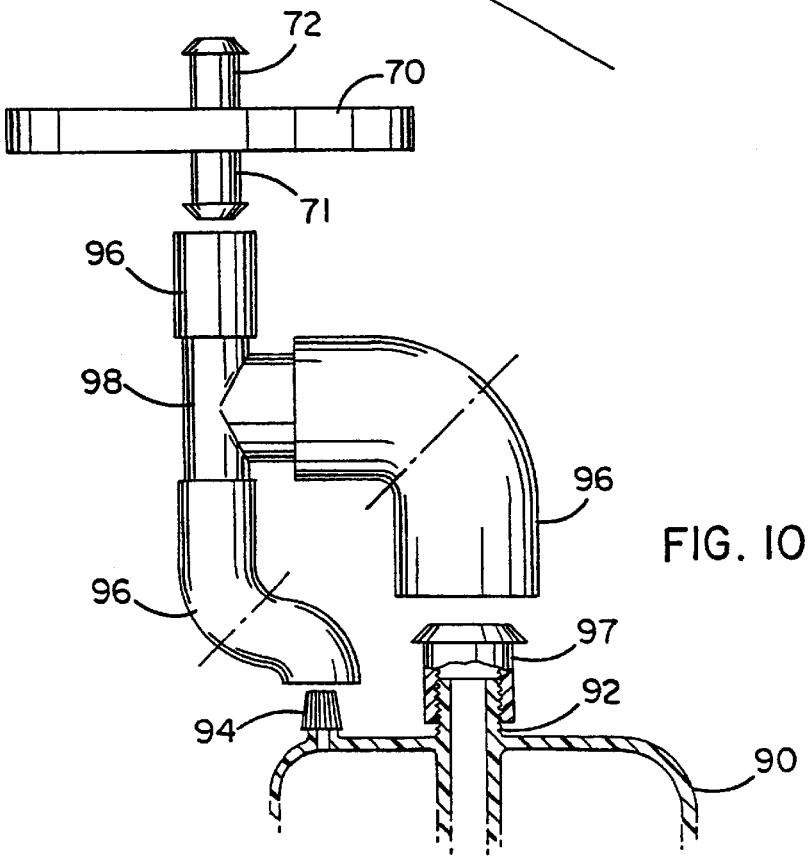
FIG. 10 is a partially cross-sectional view illustrating a method of venting a filter housing on both the upstream and downstream sides of a filter element.

If only one of the fluid ports of a filter housing 90 is vented during sanitizing by heating, a pressure differential may develop across the filter element 81 between the side communicating with the inlet 91 and the side communicating with the outlet 92. If such a pressure differential is large enough to drive vapor generated by the heating through the filter element 81, the vapor passing through the filter element 81 may result in dewetting of portions of the filter element 81. In order to prevent vapor from being driven through the filter element 81, it may be desirable to simultaneously vent the housing 90 on both the upstream and downstream sides of the filter element 81, i.e., to vent a region communicating with the inlet and a region communicating with an outlet through two or more fluid ports. For example, both the inlet 91 and the outlet 92 may be simultaneously vented, or the outlet 92 and one or both of the air vents 93, 94 may be simultaneously vented. FIG. 10 schematically illustrates an embodiment in which a filter assembly is vented from both the upstream and downstream sides of a filter element. The filter assembly in this figure, only the outlet end of which is shown, is identical to the disposable filter assembly of FIG. 8. During sanitizing, the outlet 92 and the outlet-side air vent 94 are connected to a vent filter 70 in the form of a sterilizing grade syringe filter, for example, by flexible polymeric tubing 96 and a tee fitting 98 which joins the tubing 96 for the outlet 92 with the tubing 96 for the outlet-side air vent 94. The outlet 92 is equipped with a hose barb adapter 97, as in the embodiment of FIG. 9. The cap on the air vent 94 can be removed to enable the tubing 96 to be connected to the air vent 94. If desired, the air vent 94 can be fitted with a hose barb adapter similar to the one installed on the outlet 92. Sanitizing can be performed under the same conditions described for the previous embodiments. At the completion of sanitizing and cooling, the tubing 96 for both the outlet 92 and the outlet-side air vent 94 can be severed by heating the tubing 96 along the dashed lines, for example, to melt the tubing 96 closed and hermetically seal the housing 90. One or more vent filters can be connected to a plurality of fluid ports of a housing in any other desired manner. For example, a plurality of vent filters can be directly connected to the housing 90 in the manner shown in FIG. 8.

During sanitizing, the orientation of the filter housing 90 is not critical, but preferably the housing 90 is oriented as shown in FIG. 10 so that vapor can rise to the upper end of the housing 90 and be easily vented through fluid ports 92 and 94.

The vent filters shown in FIGS. 6 and 7 can also be used in a manner similar to that shown in FIG. 5 to simultaneously vent a plurality of filter packages through a single vent filter.

Figure 11:
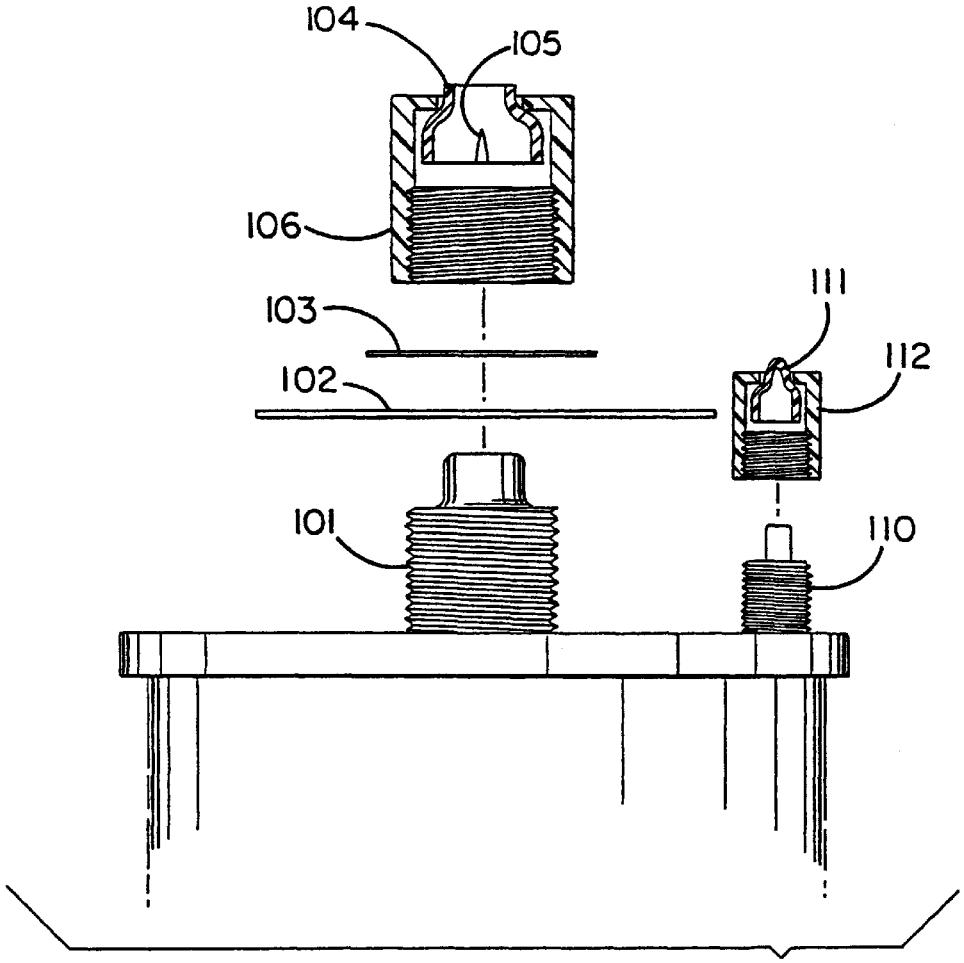
FIG. 11 is a partially cross-sectional exploded view of a portion of a filter assembly having a filter membrane mounted directly on a fluid port of the filter assembly.

According to another form of the present invention, a vent filter for use during sanitizing of a filter may comprise a filter medium mounted directly on a fluid port of a filter housing or other container. FIG. 11 illustrates a portion of an embodiment of a filter package according to the present invention employing such a vent filter. The illustrated filter package is formed from a commercially available filter assembly, such as one available from Pall Corporation under the designation LDFF, although many other types of filter assemblies can also be employed. The filter assembly includes a rigid, cylindrical polymeric housing 100 equipped at one of its ends with an outlet 101 and an outlet side air vent 110, each having a hollow bore communicating with the inside of the filter housing 100. The unillustrated opposite end of the housing 100 is equipped with an inlet and an inlet side vent similar in structure to the outlet 101 and the outlet side air vent 110. An unillustrated cylindrical filter is disposed inside the housing 100 along a fluid path connecting the inlet and the outlet 101. Like the filter 80 shown in FIG. 8, the filter of the illustrated filter assembly has a blind end cap at one of its ends and an open end cap sealed to the outlet 101 at its other end. The air vents communicate with the interior of the housing 100 surrounding the filter. Each of the fluid ports, i.e., the inlet, the outlet 101, and the air vents can be sealed by a cap-like closure and a nut which is formed separately from the closure and secures the closure to the fluid port. For example, the outlet side air vent 110 is equipped with a blind closure 111 having an open lower end which fits over the outer end of the air vent 110. A nut 112 slides over the top of the closure 111 and engages with external threads formed on the air vent 110 to hold the closure 111 in place. The outlet 101 can be sealed by a similar, unillustrated blind closure and a nut 106 for holding the blind closure in place.

Any one or more of the fluid ports of the housing 100 may be vented during sanitizing. For the reasons given with respect to the embodiment of FIG. 8, preferably at least the outlet 101 is vented to prevent vapor from accumulating within the hollow center of the filter during sanitizing. The vent filter for the outlet 101 in this embodiment comprises a sheet of filter medium 102 mounted directly over the open outer end of the outlet 101. The filter medium 102 is not restricted to any particular type but is preferably a sterilizing grade filter medium which can prevent bacteria and other contaminants from entering the housing 100 while permitting vapor to escape from the housing 100 during sanitizing. If desired, the filter medium 102 may be hydrophobic to prevent a noncontaminating liquid with which the housing 100 is filled from leaking from the housing 100 when the housing 100 is tilted. A membrane filter medium is particularly suitable as the filter medium 102 because a membrane can be sufficiently thin and flexible to readily conform to the shape of the outlet 101 without tearing. An example of a suitable membrane filter medium is a sterilizing grade PTFE membrane. Examples of other suitable membrane materials are polyvinylidene fluoride and hydrophobic nylon. The thickness of the filter medium 102 is not limited and can be chosen based on the strength desired of it. Typically, the thickness will be in the range of 0.0254–0.127 mm. Depending upon the physical strength of the filter medium 102, it may be desirable to dispose a support member 103 which is permeable to vapor of the noncontaminating liquid and stiffer than the filter medium 102 adjacent the outer surface of the filter medium 102 to prevent the filter medium 102 from bulging outwards during sanitizing. A similar support member 103 can also be disposed adjacent the inner surface of the filter medium 102 to prevent the medium 102 from deforming inwards as well. In the present embodiment, the support member 103 comprises a thin sheet of a porous, nonwoven fluoropolymer fabric which is permeable to vapor of the noncontaminating liquid. Examples of other possible support members are a thin perforated plate, a porous woven fabric, and a porous mesh. It is generally not necessary for the support member 103 to perform any function except physically support the filter medium 102, i.e., it is not necessary for the support member 103 to remove particulates from fluid which passes through it during sanitizing, and preferably the support member 103 is sufficiently porous that it does not produce any significant pressure drop.

The filter medium 102 and the support member 103 can be of any convenient size, but preferably each has a surface area which is at least as large as the cross-sectional area of the bore in the outlet 101 so that they can completely cover the bore. They may be cut from sheets into any convenient shape.

Figure 12:
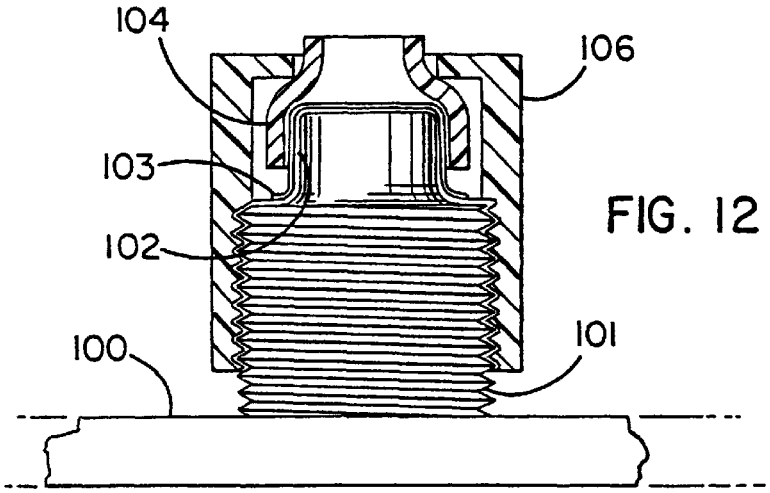
FIG. 12 is a partially cross-sectional view of the outlet of the filter assembly of FIG. 11 as it appears during sanitizing.

The filter medium 102 and the support member 103 can be attached to the outlet 101 in any desired manner which can prevent microorganisms and other contaminants from bypassing the filter medium 102, such as by bonding or by a mechanical connector (a ring, a hose clamp, etc.) which fits around the outlet 101 and grasps the filter medium 102. A mechanical connection is generally preferable to bonding, since bonding has the potential to damage the filter medium 101 or the housing 100 and introduce contamination. In the illustrated embodiment, after the housing 100 has been filled with a noncontaminating liquid to immerse the filter contained within the housing 100, the medium 102 and the support member 103 are placed over the top of the outlet 101 and then held in place by an open-ended, cap-like closure 104 which slides over the outer end of the outlet 101 and is retained by nut 106 which slides over the closure 104 and engages with external threads formed on the outlet 101. FIG. 12 shows the appearance of the outlet 101 during sanitizing. The filter medium 102 is sufficiently thin and flexible that it can be laid over the threads of the outlet 101 and the nut 106 can be screwed over the filter medium 102 without damage to the portion of the filter medium 102 covering the outer end of the bore of the outlet 101. The open-ended closure 104 can be initially manufactured with an open end, or it can be obtained by cutting off the blind end of a blind closure like the closure 111 for the outlet side air vent 110, or by punching perforations in the outer end of a blind closure. To make it easier to slide the open-ended closure 104 over both the filter medium 102 and the support member 103, one or more axial slits 105 may be cut in the outer wall of the closure 104 to permit radial expansion of the closure 104.

Any of the other fluid ports of the housing 100 may also be provided with a vent filter of the type employed for the outlet 101, or with any other type of vent filter.

The illustrated filter assembly can be sanitized under the same conditions described with respect to any of the previous embodiments. When the filter assembly is sanitized by heating in an autoclave, the outlet 101 is preferably elevated with respect to the rest of the housing 100 so that the vapor which is generated during heating can rise towards the outlet 101 and be readily vented from the housing 100. At the completion of cooling of the filter assembly following sanitizing, if the filter medium 102 is hydrophobic, the filter housing 100 may be shipped to the customer with the open-ended closure 104 left on the outlet 101, since the hydrophobic filter medium 102 can prevent water from leaking out of the housing 100. However, to prevent the filter medium 102 from being inadvertently punctured during handling of the filter assembly, it may be desirable to replace the open-ended closure 104 with a blind closure or other member which can protect the filter medium 102, like the blind closure 111 for the outlet side air vent 110. The open-ended closure 104 can be easily replaced by unscrewing the nut 106 from the outlet 101, removing the open-ended closure 104 without removing the filter medium 102, and then placing a blind closure over the filter medium 102. At this time, the support member 103 may be either left in place atop the filter medium 102 or removed to make it easier for the blind closure to slide over the outlet 101. The blind closure may be loosely mounted on the outlet 101, or it may be pressed tightly against the outlet 101 by the nut 106 to hermetically seal the housing 100. When a customer is ready to use the filter package, he can remove the nut 106 and the blind closure and then peel the support member 103 (if still present) and the filter medium 102 off the outlet 101. Since no bonding agent is used to attach the filter medium 102 to the outlet 101, the filter medium 102 can be easily separated from the outlet 101 without leaving any residue.

In a similar manner, a filter medium can also be mounted directly on the outer ends of the vent tubes 42 and 65 used in the embodiments of FIGS. 1–7 in which a container of a filter package comprises a flexible bag 20. For example, a membrane filter medium and a support member can be disposed over the outer end of a vent tube and held in place by an open-ended closure and a nut like those used in the embodiment of FIGS. 11 and 12. Similarly, a filter medium can be mounted directly on any of the fluid ports of the filter assembly shown in FIG. 8.

A vent filter comprising a filter medium mounted directly on a fluid port of a container is advantageous in that it can be readily assembly by a user from inexpensive hardware, so equipment costs are extremely low.

The present invention will be further illustrated by the following examples.

EXAMPLE 1

A rectangular sheet of PFA film measuring 6 inches×18 inches and having a thickness of 0.005 inches was folded in half and then heat sealed along two edges to obtain an elongated bag measuring 3 inches×18 inches and having one open end. A vent hole was punched in the bag near the open end using a hole punch, and a vent tube like that shown in FIG. 3 was sealingly connected to the bag at the vent hole.

A pleated filter (AB1F0013EH1 filter available from Pall Corporation under the trade designation "Super-Cheminert" and having a PTFE single-layer filter medium) was prewetted by dipping in isopropyl alcohol for 5 minutes at room temperature (approximately 25° C.). The isopropyl alcohol was then removed by flushing the filter with deionized water for at least 5 minutes. The filter was next transferred to a tank of hot deionized water at approximately 71° C. for 60 minutes to perform leaching. The filter was then placed into the bag through the open end, and this end was sealed using a heat sealer.

Ultrapure deionized water (initial resistivity of 18 MΩ-cm) was introduced into the bag through the vent tube to completely submerge the filter. A hydrophobic, sterilizing grade PFA filter (Pall Model DFA4001FRP) was then sealingly connected to the vent tube as a vent filter.

The bag was next placed into an autoclave and heated for one hour under standard sterilizing conditions of 15 psi gauge and approximately 120° C. to sterilize the contents of the bag. At the end of one hour, the bag was removed from the autoclave and cooled in air to a safe handling temperature. The bag was then hermetically sealed below the surface of the water using a heat sealer to obtain a completed filter package. At the time of sealing, the upper portion of the bag including the vent tube and the vent filter was detached from the lower portion of the bag containing the filter. The vent tube, the associated hardware, and the vent filter were detached from the upper portion of the bag for reuse, and the upper portion of the bag was discarded.

EXAMPLE 2

This example illustrates sterilizing a filter assembly like that illustrated in FIG. 8 to obtain a sterilized filter package. The filter assembly, which comprises a filter 80 and a rigid polymeric housing 90, is a disposable filter assembly available from Pall Corporation under the trademark DFA.

The filter 80 is prewetted by passing isopropyl alcohol at room temperature (approximately 25° C.) through the housing 90, the isopropyl alcohol being introduced through the inlet 91 and discharged through the outlet 92. The isopropyl alcohol is then removed by flushing the filter housing 90 with deionized water for 5 minutes. The deionized water is then allowed to drain from the housing 90.

The outlet-side air vent 94 is shut, the outlet 92 is closed with a threaded cap 95, and ultrapure deionized water (initial resistivity of 18 MΩ-cm) is introduced into the housing 90 through the inlet 91 with the inlet-side air vent 93 open and the housing 90 upright so that air can escape through the inlet-side air vent 93. When the ultrapure deionized water reaches the top of the inlet 91, the inlet-side air vent 93 is shut and the inlet 91 is closed with a cap 95. The housing 90 is then inverted, the outlet-side air vent 94 and the outlet 92 are opened, and additional ultrapure deionized water, if necessary, is added to the housing 90 through the outlet 92 to completely fill the housing 90 and exclude all air from the housing 90. In this state, the filter 80 is completely immersed in the ultrapure deionized water inside the housing 90. The closure for the outlet-side air vent 94 is removed, and a vent filter 60 like that shown in FIG. 6 comprising a filter holder and a hydrophobic, sterilizing grade membrane filter medium 64 is attached to both the outlet 92 and the outlet-side air vent 94 by tubing 96 and a tee fitting 98 in the manner shown in FIG. 10. The uppermost end of the tubing 96 is attached to fluid port 61*a* of the vent filter 60.

The filter assembly and the vent filter 60 are then placed into an autoclave and heated for one hour at 15 psi gauge and approximately 120° C. to sterilize the entire filter assembly. During sterilizing, the housing 90 is substantially upright with the outlet 92 disposed higher than the inlet 91. At the end of this time, the filter assembly and the vent filter 60 are removed from the autoclave and cooled in air to a safe handling temperature. The tubing 96 is then severed by heating the tubing 96 at a location between the tee fitting 98 and the filter assembly to hermetically seal the assembly and obtain a completed filter package. The tubing 96 can be removed from the filter assembly by the customer when he is ready to use the assembly. The vent filter 60 can be reused with the same or a different filter medium 64.

What is claimed is:

1. A filter package having a long-shelf life and containing substantially no contaminants, the filter package comprising a filter cartridge having a porous filter medium including a plurality of pores through which a fluid can pass between an upstream side and a downstream side of the filter cartridge, a flexible bag which surrounds the filter cartridge and has walls comprising a polymeric material impervious to microorganism and liquid water, a venting mechanism formed in a wall of the flexible bag, the venting mechanism including a vent filter preventing the passage of microorganisms into the flexible bag and sanitized water sealed inside the flexible bag and substantially permeating the pores of the filter medium and immersing substantially 100% of a volume of the filter cartridge.

2. The filter package according to claim 1 wherein the venting mechanism comprises a semipermeable membrane forming a portion of the flexible bag.

3. The filter package according to claim 1 wherein the venting mechanism comprises a vent hole and a hollow vent tube connected to the vent hole and communicating between the inside and outside of the bag.

4. The filter package according to claim 3 wherein the vent filter is hermetically sealed to the vent tube.

* * * * *